US008006536B2

(12) United States Patent
Nelson et al.

(10) Patent No.: US 8,006,536 B2
(45) Date of Patent: Aug. 30, 2011

(54) DIE TRANSFER APPARATUS

(75) Inventors: Thomas J. Nelson, Isanti, MN (US); Matthew Klun, Blaine, MN (US)

(73) Assignee: Greatbatch Ltd., Clarence, NY (US)

( * ) Notice: Subject to any disclaimer, the term of this patent is extended or adjusted under 35 U.S.C. 154(b) by 847 days.

(21) Appl. No.: 11/734,115

(22) Filed: Apr. 11, 2007

(65) Prior Publication Data

US 2008/0250840 A1 Oct. 16, 2008

(51) Int. Cl.
*B21J 11/00* (2006.01)
*B21D 22/00* (2006.01)

(52) U.S. Cl. ..... 72/405.01; 72/361

(58) Field of Classification Search ..... 72/361, 72/405.01, 405.07, 405.09, 405.12, 405.13, 72/421, 347, 349, 404, 419
See application file for complete search history.

(56) References Cited

U.S. PATENT DOCUMENTS 1,935,854 A * 11/1933 McCreary ..... 72/349
4,987,762 A * 1/1991 Cash, Sr. ..... 72/349

* cited by examiner

*Primary Examiner* — Teresa Ekiert
(74) *Attorney, Agent, or Firm* — Nawrocki, Rooney & Sivertson, P.A.

(57) ABSTRACT

A mechanism for forming thin metallic skin enclosures from blanks. The apparatus includes a forming assembly including a plurality of die stations. The stations are stepped farther away from an axis in a direction of which blanks being processed are positioned at a plurality of die stations. Grippers spaced along the axis and away from the axis at distances substantially the same as are die stations are carried by the transfer assembly. An actuator is used to move the transfer assembly reciprocally in directions generally parallel to the axis between first and second axial positions. A ram is provided to move the transfer assembly between first and second stepped positions relative to the axis.

3 Claims, 10 Drawing Sheets

DIE TRANSFER APPARATUS

TECHNICAL FIELD

The present invention deals broadly with the field of tool and die technology. More narrowly, however, it deals with the forming of multiple, thin metallic skin enclosures from blanks. Even more narrowly, it deals with forming cases defined by a thin metallic skin. A specific focus of the invention is an apparatus and method for forming battery casings by progressively stamping a plurality of blanks at sequenced die stations.

BACKGROUND OF THE INVENTION

Various machines are known in the prior art for progressively forming blanks by passing them through sequential die stations until they conform to a desired size and shape. Successive draws take an initially flat blank of metal and deform it in such a manner so as to prevent wrinkles and cracks from forming in the blank. This is true even though its shape is changed to one that is intended depending upon the particular application to which the work piece is to be put. The ultimate application may be a medical enclosure for a defibrillator or a pacemaker.

Prior art structures employ tools for each individual draw. In some instances, the case needs to be washed and annealed in order to maintain a sufficient degree of pliability for the next successive draw. The time element can be critical in going from draw to draw. Depending upon the number of draws necessary and the treatment between draws, it can take several weeks to complete a particular work piece.

The specific process typically utilized in the prior art passes parts in what is known as a common pass line. In such a methodology, all the presses are in the same horizontal plane. All the tooling has to be in that horizontal plane, and the work pieces are inserted into the draw tool and extracted from the draw tool from the same surface. Such methodology substantially effects drawing the work piece twice because the metal passes twice over the surfaces that actually effect deformation. Such a process can reduce quality by deforming the work piece to push back out a tool. By doing so, a geometry change can occur.

As was previously discussed, time can be an important factor. In one application of such a methodology, a period of time of 45 minutes between draws can be excessive. There is a natural tendency to allow a quantity of work pieces to build up at one machine before they are passed to the next machine. Similarly, because of break time and shift changes, parts may sit unattended for in excess of 45 minutes.

It is to these dictates and shortcomings of the prior art that the present invention is directed. It includes apparatus and methods for sequentially forming a plurality of thin metallic skin structures which solve problems in the prior art.

SUMMARY OF THE INVENTION

The present invention focuses upon both apparatus and methods. It includes apparatus for forming a plurality of enclosures having thin metallic walls. Such enclosures are formed by sequencing a plurality of blanks through progressive die stations. The apparatus includes a forming assembly which has a plurality of die stations spaced along an axis. The stations are stepped serially farther away from the axis in a direction perpendicular to the direction of movement of the blanks along the axis. The stations serve to progressively form the blanks as they are sequentially transferred in the direction of movement along the axis and from one station to another. A transfer assembly mounts a plurality of gripping means for gripping the blanks to transfer them from one station to the next. Such gripping means are spaced from each other along the axis and are serially stepped away from the axis at distances substantially the same as are the die stations. Actuator means to effect movement of the transfer assembly reciprocally in directions generally parallel to the axis are provided. The actuator means move the transfer assembly between a first axial position, in which the gripping means are registered with corresponding die stations, and a second axial position, in which each gripping means is registered with a die station adjacent the station with which it is registered when the transfer assembly is in its first position, advanced in a direction of movement from the first position. Also provided is a ram which moves the transfer assembly between a first stepped position in which the gripping means are withdrawn from the die stations, and a second stepped position, in which the gripping means engage blanks at the die stations.

The actuator means by which the transfer assembly is moved between its first and second axial positions can be pneumatic in nature. By employing a system so constructed, the transfer assembly can be efficiently moved between its first and second axial positions.

Similarly, pneumatic means can be provided to operate the ram in moving the transfer assembly between the first stepped position and the second stepped position. Again, it has been found that such a ram can be optimally operated to accomplish its intended goals.

The present invention is thus an improved apparatus and method for forming multiple metallic enclosures from blanks. More specific features and advantages obtained in view of those features will become apparent with reference to the appended DETAILED DESCRIPTION OF THE INVENTION, appended claims and accompanying drawing figures.

DETAILED DESCRIPTION OF THE INVENTION

Figure 1:
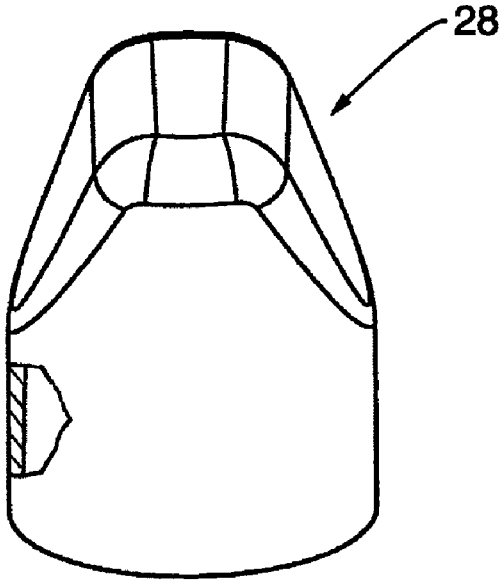
FIG. 1 is a perspective view of a work piece after a first draw at a die station.
Figure 2:
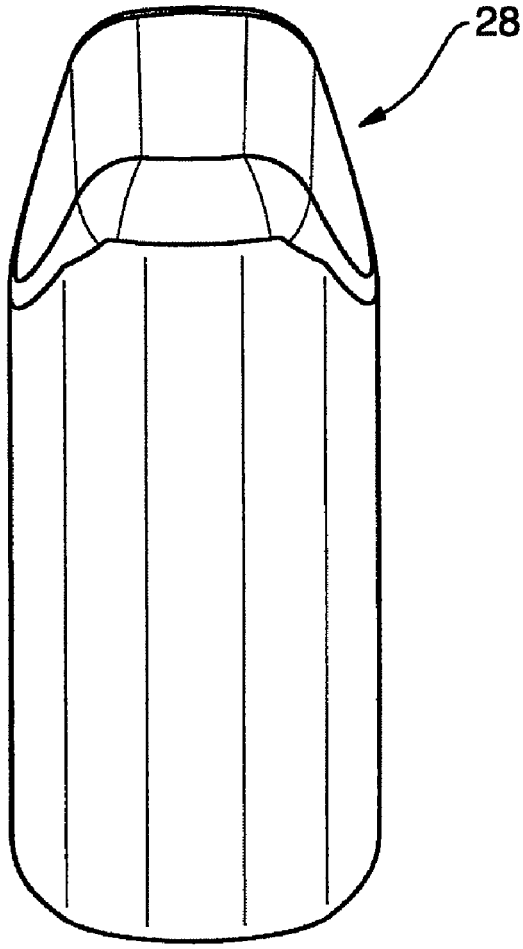
FIG. 2 is a perspective view of a work piece after a second draw at a die station.
Figure 3:
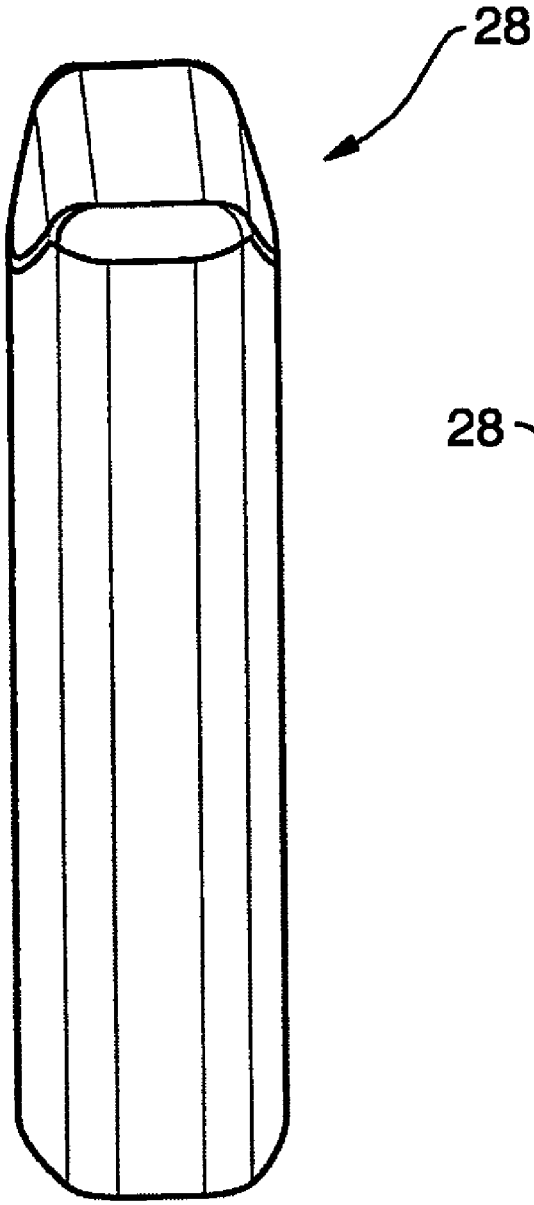
FIG. 3 is a perspective view of a work piece after a third draw at a die station.
Figure 4:
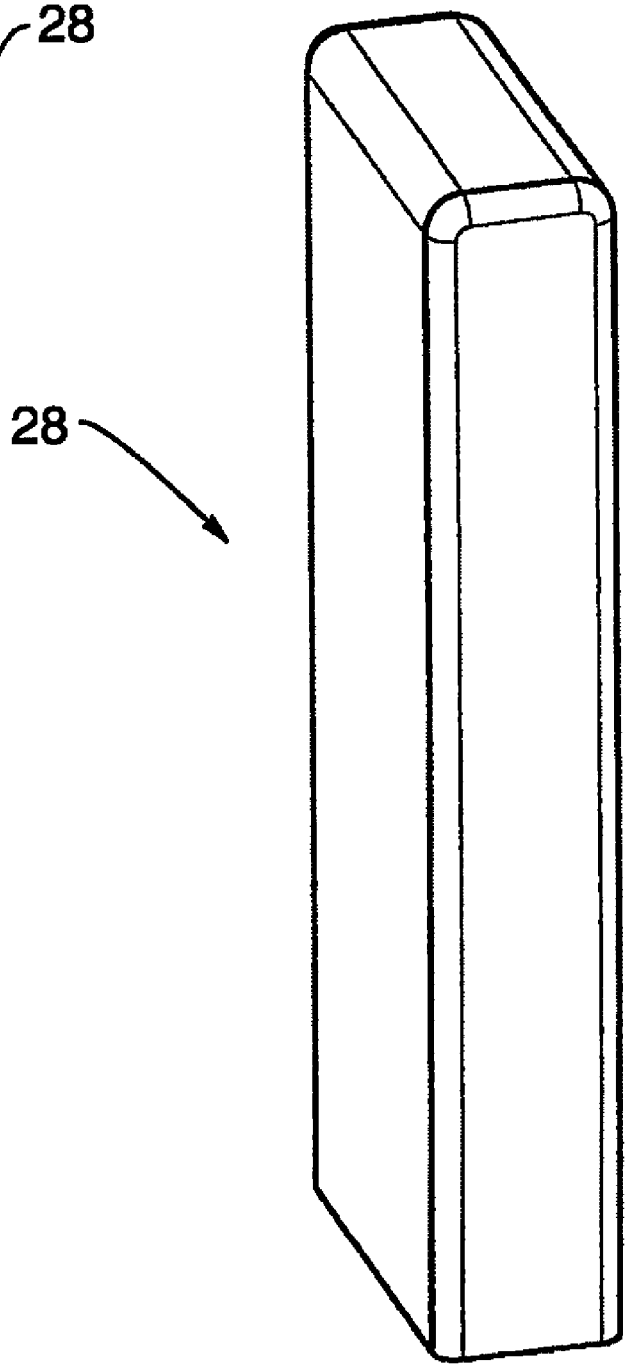
FIG. 4 is a perspective view of a work piece after a fourth and final draw at a die station.
Figure 5:
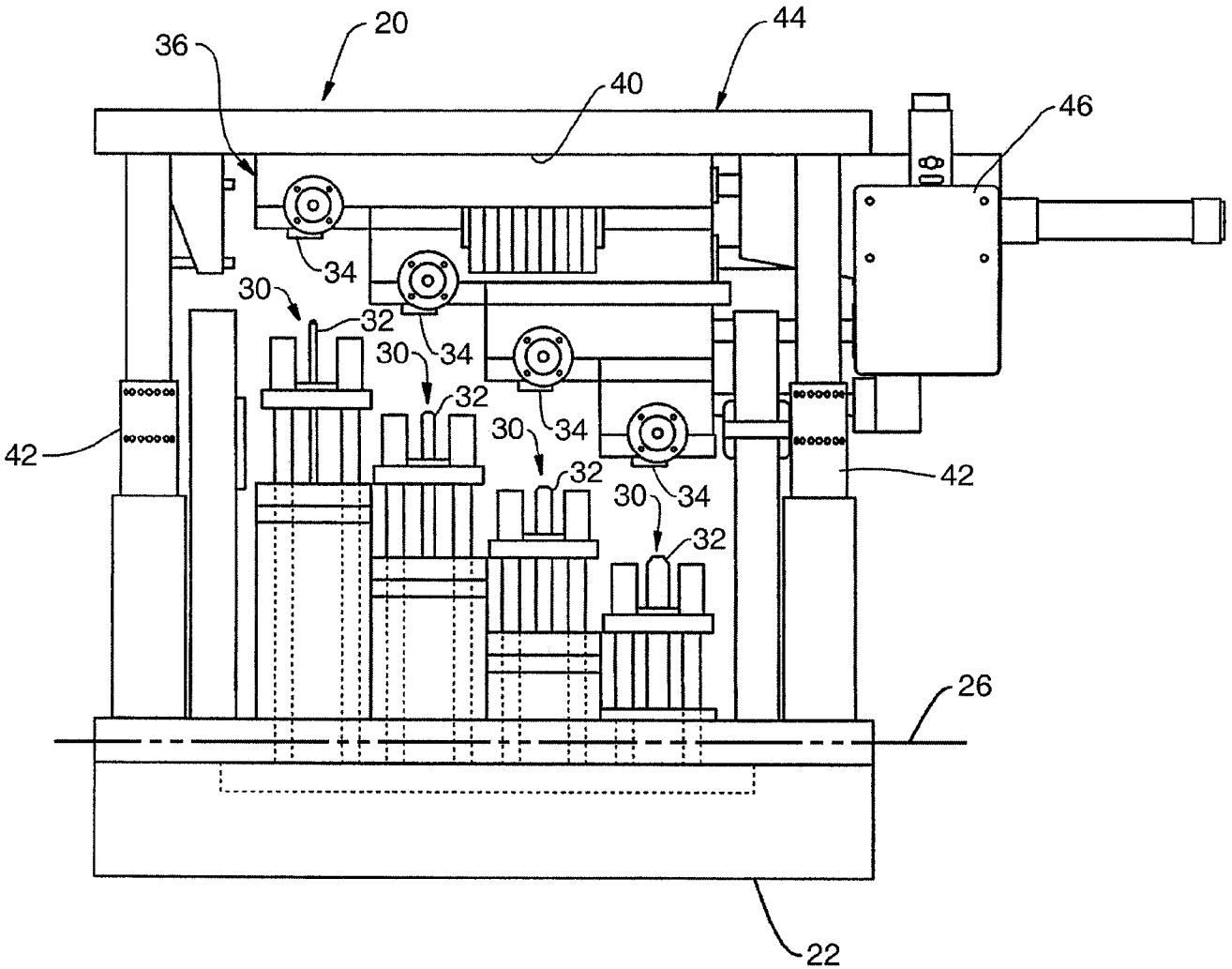
FIG. 5 is a simplified side elevational view of an apparatus in accordance with the present invention with a transfer assembly in its first axial position and its first stepped position.

Referring now to the drawing figures wherein like reference numerals denote like elements throughout the several views, FIGS. 6, 8-9 and 12 illustrate an apparatus 20 in accordance with the present invention. FIG. 5 is a simplified illustration of the apparatus 20 of FIGS. 6, 8-9 and 12. Initial discussion is made with reference to FIG. 5. That figure illustrates a base 22 which mounts a forming assembly 24. The assembly 24 is elongated along an axis 26. The axis 26 extends in a direction of movement of work pieces 28 through a plurality of die stations 30 spaced along the axis 26 of the base 22.

Each die station 30 mounts a tool 32 which, when work pieces 28 are successively processed through from station to station, the shape of a work piece will be progressively more conformed to an intended shape and size. As seen in FIG. 5, the tools 32, moving in a right-to-left direction in that figure, are successively smaller in cross-section.

FIGS. 1-4 illustrate the size and shape of a work piece blank 28 as it proceeds in a direction of the axis 26 from station to station. The work piece 28 being formed, as illustrated by FIGS. 1-4, is a casing for use in an implantable medical device. While the figures do not illustrate the specific shape of tools 32 to achieve the shape and size of the work piece illustrated in FIGS. 1-4, it will be understood that any shaped sequentially processing tools to achieve a particular constructed work piece can be utilized. It should also be understood, of course, that a die 34, cooperating with a particular tool 32, would also be utilized in the forming process.

FIG. 5 illustrates a stepping of sequenced stations 30 wherein they are defined serially farther away from the axis 26 in a direction generally perpendicular to the direction of movement of the work pieces 28 along the axis 26. Such stepping is for a purpose as will be discussed hereinafter.

The figures also illustrate a transfer assembly 36 which mounts a pair of gripping fingers 38 and a die structure corresponding to a tool at a die station 30. It is the cooperation of the tool 32 and its corresponding die 34 which effects processing of a work piece 28 at a particular station 30. As will be seen in the figures, the finger gripping means 38 corresponding to a particular die station 30 are stepped from an adjacent station in an amount similar to the distance at which the die stations 30 are stepped from the axis 26.

The gripping means structures are positioned on a platen 40. The platen 40 is carried by a series of telescoping mounts 42 which allow for the transfer assembly 36 to move from a position wherein the gripping means is withdrawn from engagement of the corresponding tool, to another position wherein the gripping means engage a corresponding tool to effect sequential formation of the work pieces 28. A ram 44 is provided to mount the transfer assembly 36 for movement between the first, withdrawn position, and the second, extended position.

As will be apparent, the die structures 34 are ganged. That is, they are fixed with respect to each other in a defined spatial relationship.

Figure 12:
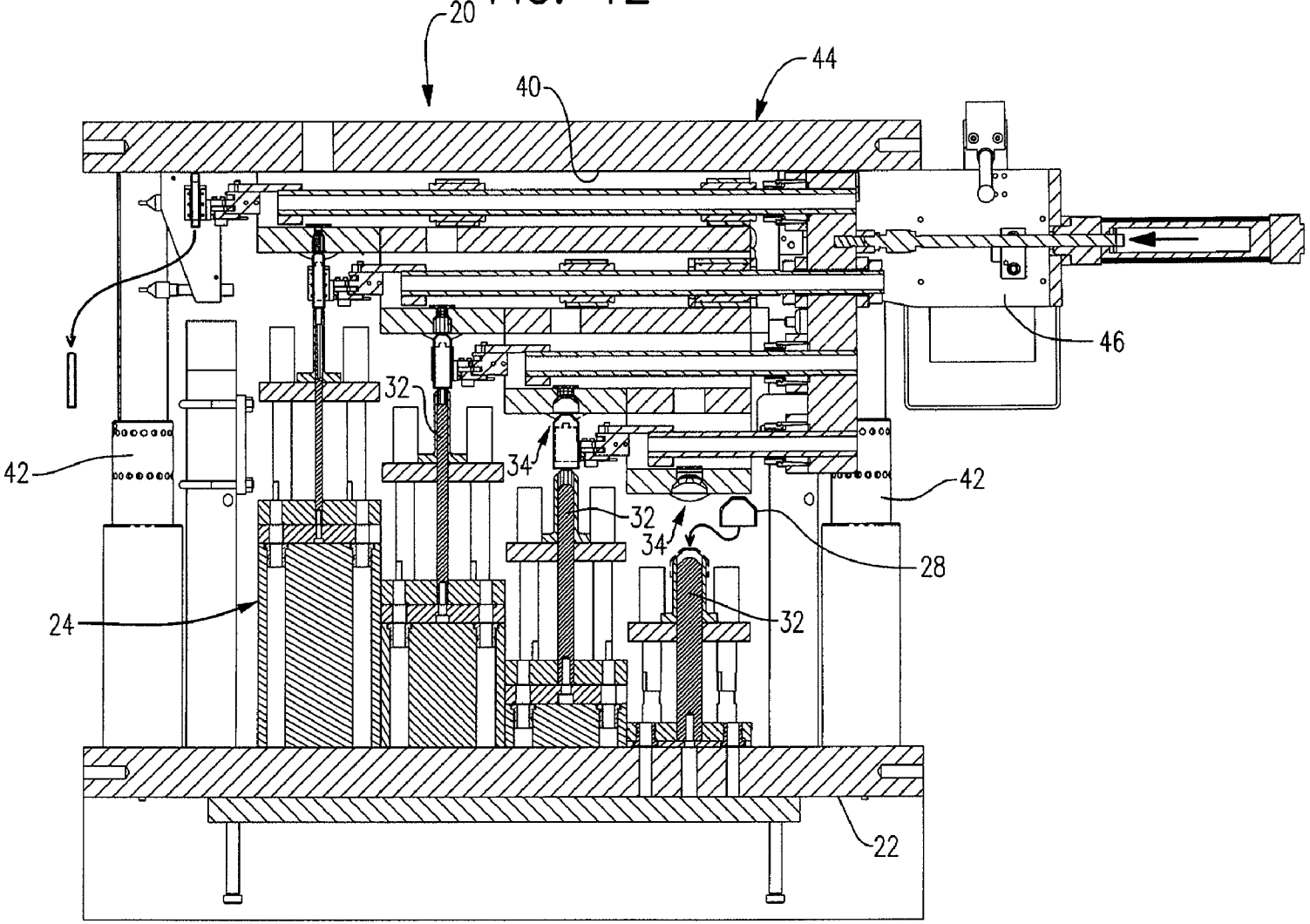
FIG. 12 is a view similar to FIG. 6 with the transfer assembly in its second axial position and its first stepped position.

The transfer assembly 36 is also mounted for movement in a direction along the axis 26. Movement is between a first position and a second position. When the transfer assembly 36 is in its first position, the various gripping means 38 assemblies are substantially registered with their corresponding tools 32 at the die stations 30. When the transfer assembly 36 is in its second axial position, the gripping means assemblies are generally registered with a die station and its corresponding tool spaced one station to the left (as viewed in FIG. 5). This second axial position of the transfer assembly 36 is illustrated in FIG. 12.

It will be understood that actuator means for moving the transfer assembly 36 reciprocally in an axial direction between its first and second positions, and movement of the transfer assembly 36 by the ram 44 in a direction generally perpendicular to axial movement can be accomplished by an actuator 46 of any appropriate means. It has been found that a pneumatic actuation means is appropriate.

Figure 6:
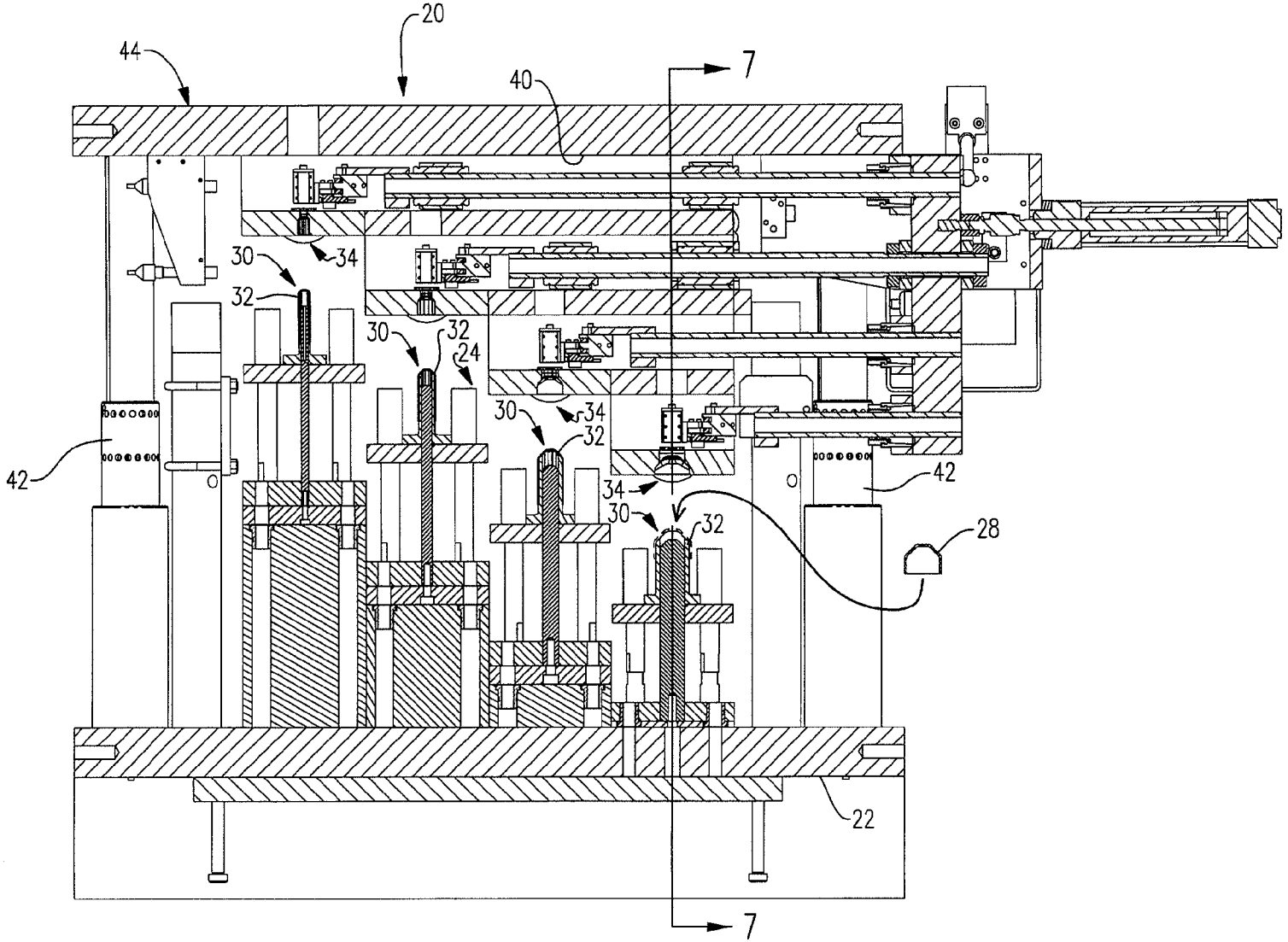
FIG. 6 is a view similar to FIG. 5 but in more detail.

In operation, an initially structured work piece 28, as illustrated in FIG. 6, is placed over the tool 32 at the first station. Such positioning of the work piece 28 can be accomplished either manually or by employment of a mechanical transfer structure (not shown). The transfer assembly 36 is initially in its first positions both axially and in a direction stepped perpendicular to axial movement. The first movement of the transfer assembly 36 is accomplished by actuating the ram 44 to move the transfer assembly 36 from its first stepped position to the second stepped position. This movement will cause forming to be brought to bear upon the work piece in the first station (that is, in the right-most station as viewed in the figures).

Figure 7:
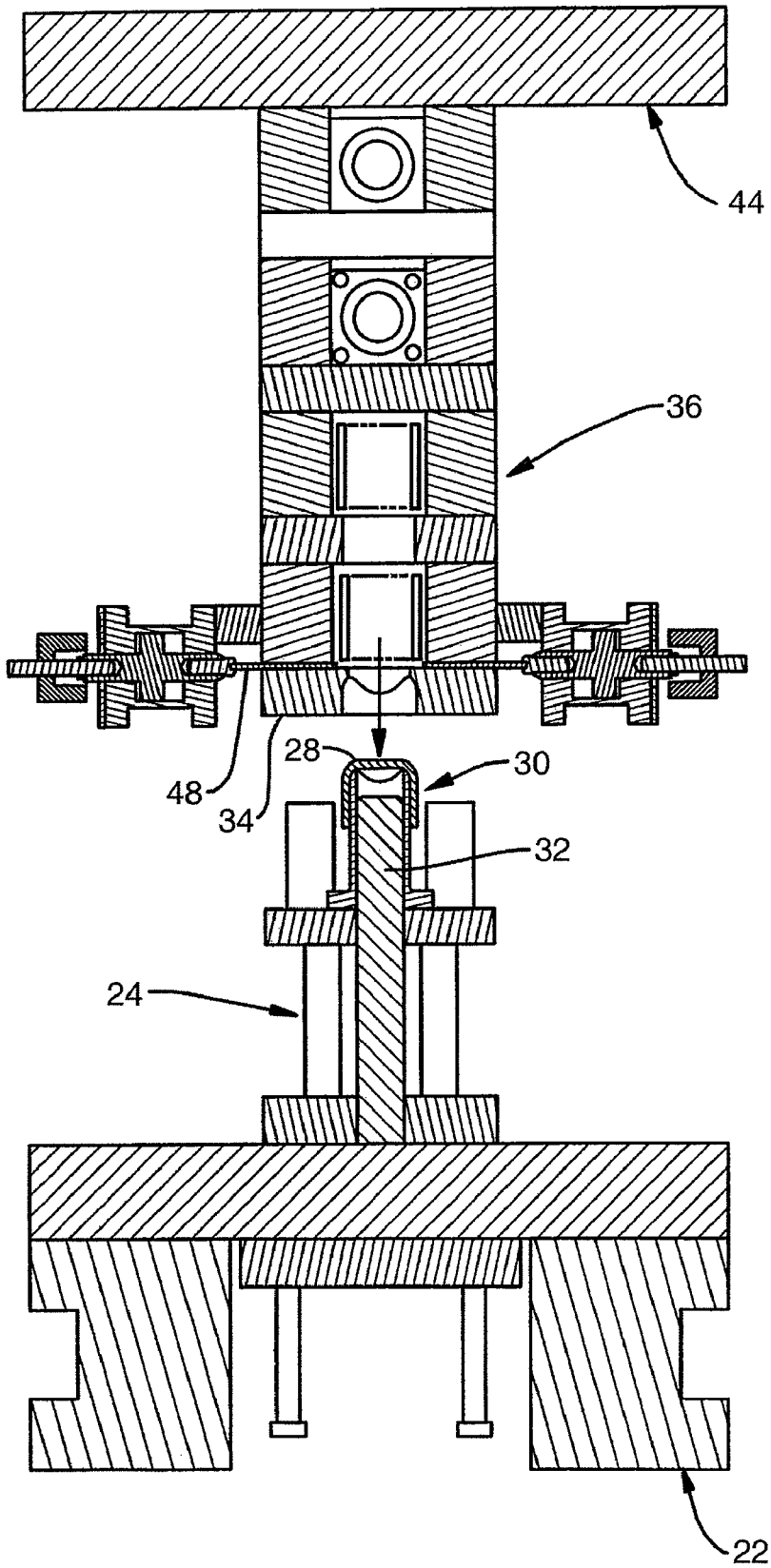
FIG. 7 is an enlarged view illustrating a die station.
Figure 8:
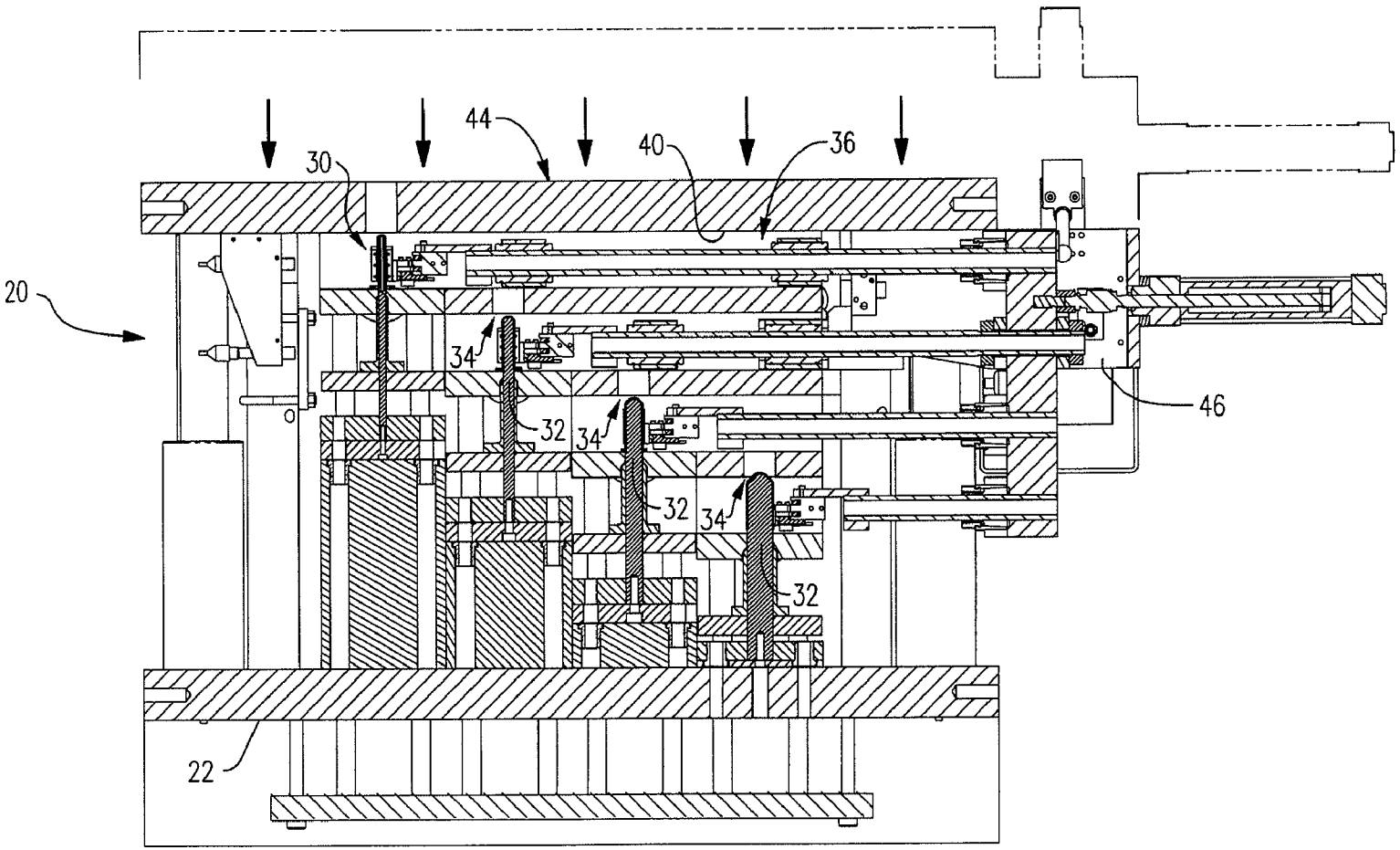
FIG. 8 is a view similar to FIG. 6 with the transfer assembly in a first axial position and a second stepped position.
Figure 9:
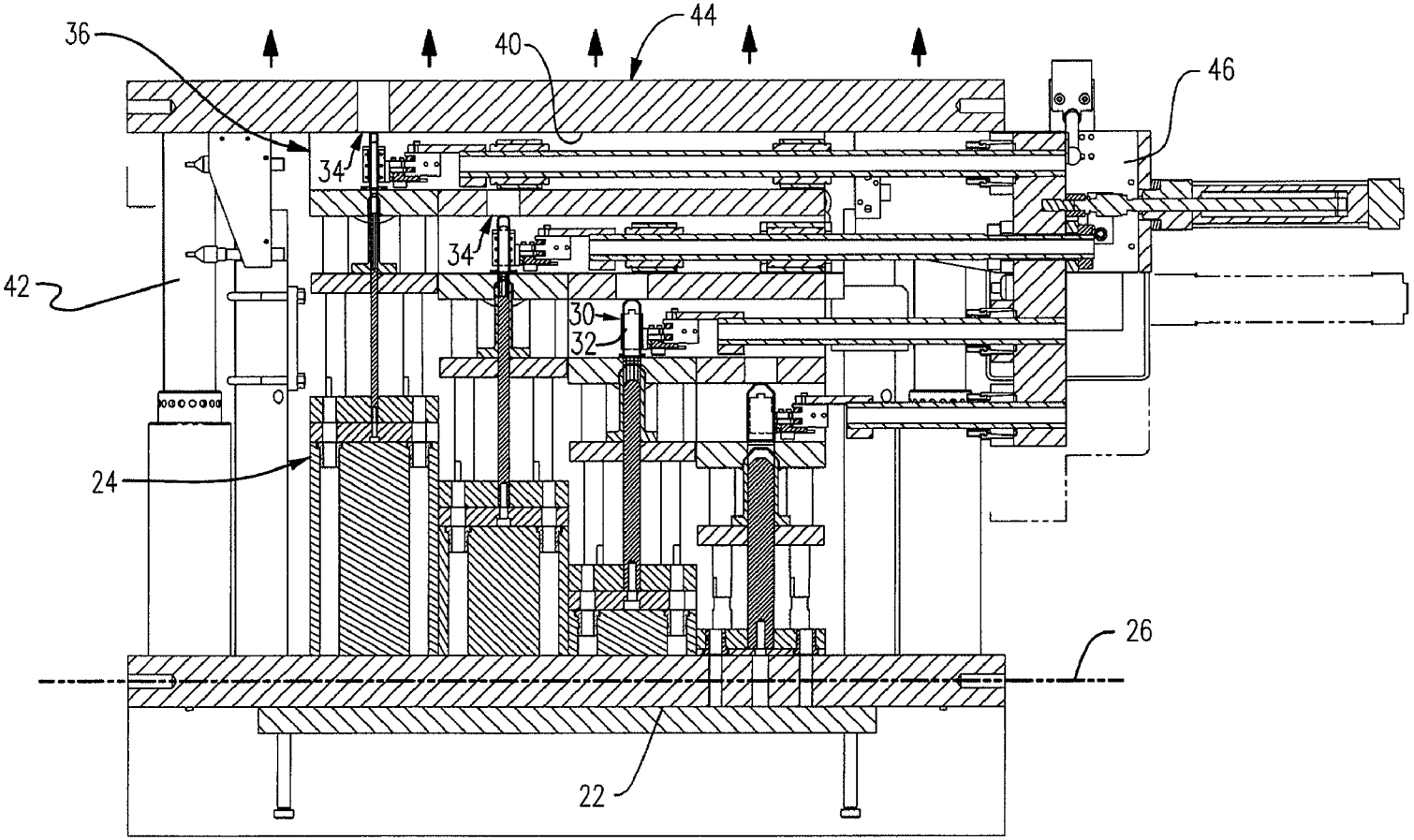
FIG. 9 is a view similar to FIG. 8 but with a ram retracting the transfer assembly back toward its first stepped position.

When this forming process is completed, the ram 44 withdraws the transfer assembly 36 to the first stepped position. As withdrawal of the ram 44 proceeds, a stripper 48, shown in FIG. 7, will facilitate removal of the work piece 28 from the tool 32, and a pair of fingers 38 of gripping means will grasp the work piece 28 to hold it as the transfer assembly 36 is cycled.

When the transfer assembly is withdrawn to its first stepped position, actuation means then function to move the assembly 36 in an axial direction to a location wherein the gripping means 38 holding the work piece 28 becomes substantially registered with the second die station. Such a station is the one immediately adjacent the first station at which processing has already occurred. With the transfer assembly 36 in this position, another blank, which can be pre-processed, is placed over the tool 32 in the first station. The ram 44 then moves the transfer assembly 36, after the fingers 38 having released the first work piece at the second die station, back to its first stepped position. As will be able to be seen, two stations now hold sequentially-processed work pieces 28 over their respective tools 32. The ram 44 then moves the corresponding dies 34 in a downward direction to process the work pieces 28 in the first and second stations. Subsequent insertion of a pre-processed work piece at Station 1 as previously processed blanks have moved on to subsequent stations will allow for sequential processing of the work pieces in third and fourth stations.

It will be understood that, while four stations are shown in the various figures, a number greater or smaller than four is within the contemplation of the invention. Circumstances might, in fact, dictate six or more stations for processing.

Figure 10:
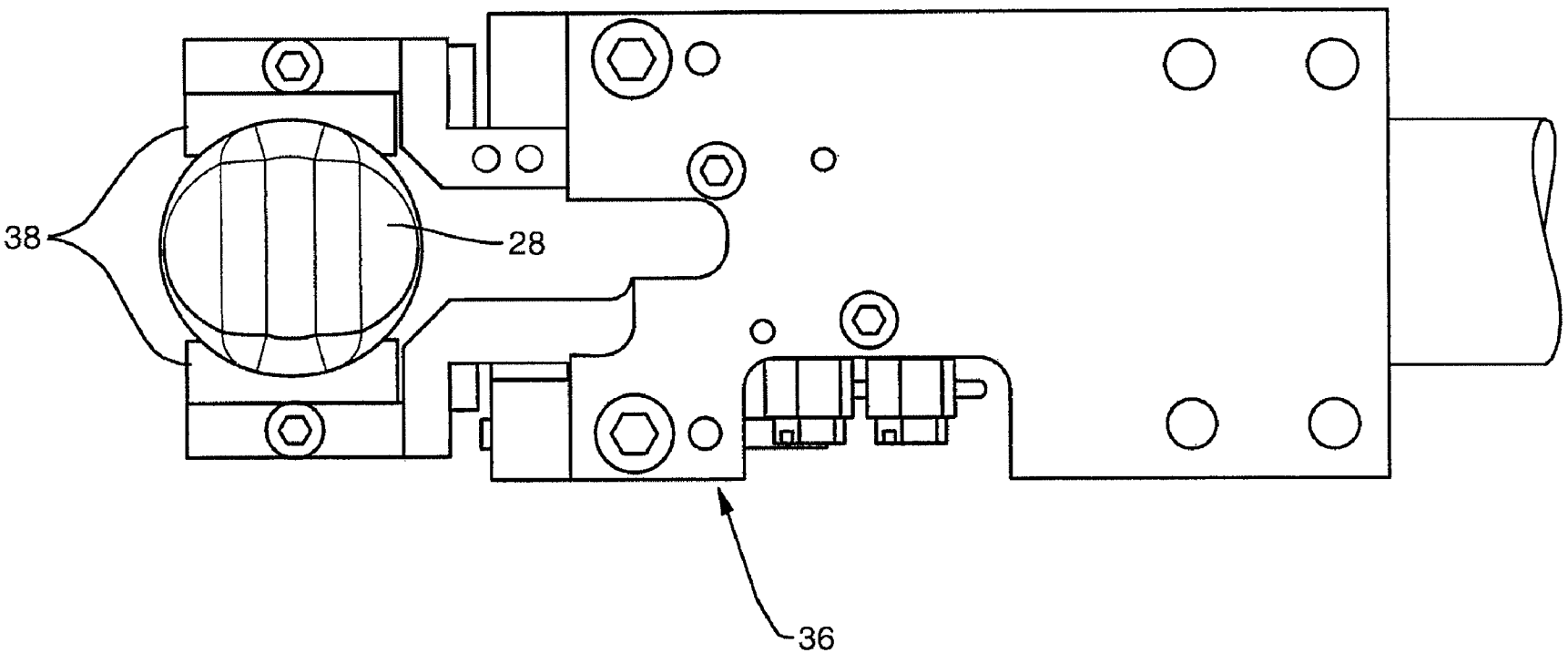
FIG. 10 is a top plan view illustrating a set of grippers gripping a work piece.
Figure 11:
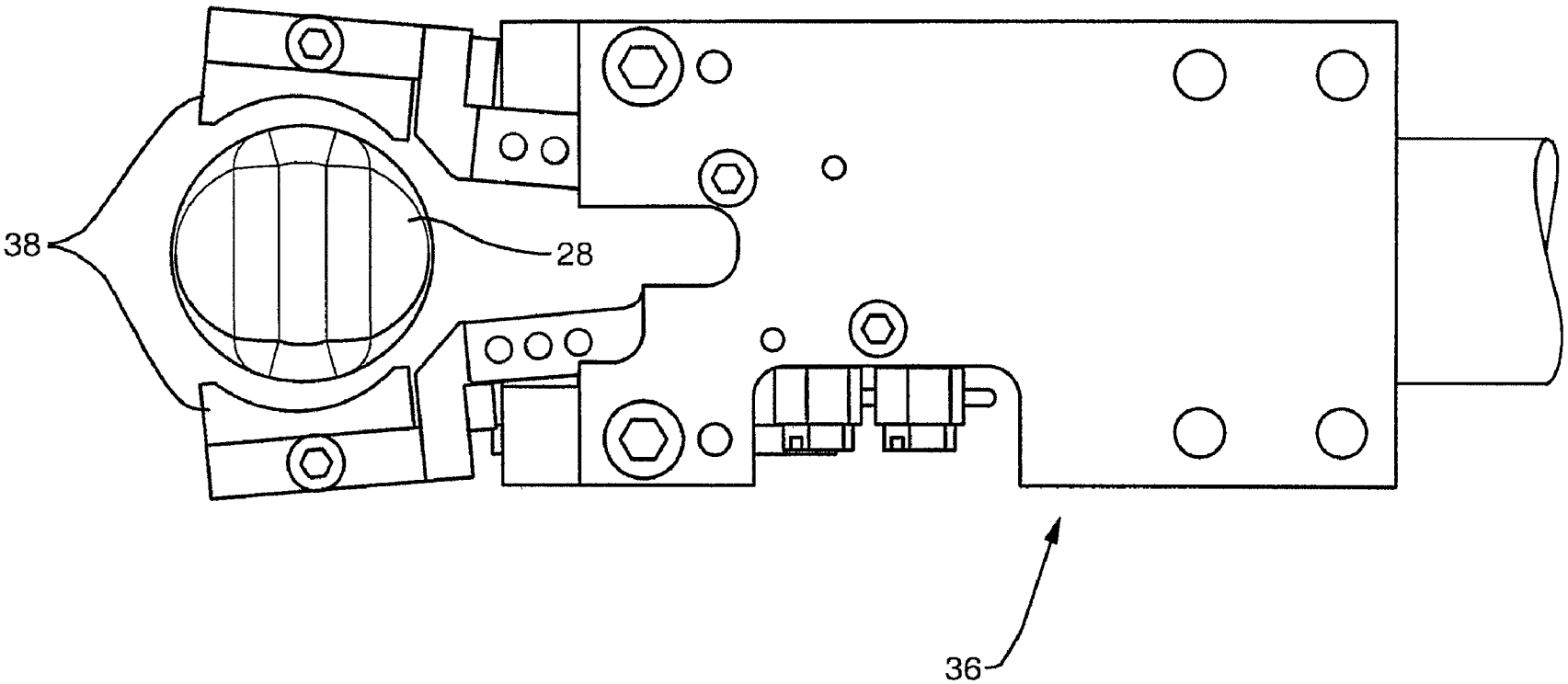
FIG. 11 is a view similar to FIG. 10 showing the set of grippers releasing the work piece.

FIGS. 10 and 11 illustrate, in plan, the functioning of gasping fingers. FIG. 10 illustrates the fingers closed onto the workpiece with which the fingers are cooperating. FIG. 11 shows the fingers in their release mode. Actuation of the fingers is, of course, coordinated with the positioning of the transfer assembly. Opening and closing of the fingers can be accomplished by mechanical means, a pneumatic system, etc.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. Apparatus for forming multiple, thin metallic skin enclosures from blanks, comprising:

(a) a forming assembly including a plurality of die stations rigidly fixed relative to one another and spaced axially with respect to an axis, said stations also stepped serially farther away from said axis in a direction generally perpendicular to a direction of movement along said axis, said stations for progressively forming the blanks as they are sequentially transferred in a direction of movement along said axis from one station to another;

(b) a transfer assembly mounting a plurality of means for gripping the blanks, said gripping means rigidly spaced from each other along said axis and serially stepped away from said axis at distances and relative positions substantially the same as said die stations;

(c) actuator means for moving said transfer assembly reciprocally in directions generally parallel to said axis between a first axial position, in which said gripping means are registered with corresponding die stations, and a second axial position, in which each gripping means is registered with a die station adjacent the die station with which it is registered when said transfer assembly is in said first position but advanced in a direction of movement from said first position; and (d) a single ram for moving said transfer assembly between a first stepped position, in which said gripping means are withdrawn from said die stations, and a second stepped position, in which said gripping means can engage blanks at said die stations.

2. Apparatus in accordance with claim 1 wherein said means for gripping comprises a pair of fingers movable between grasping and release positions.

3. Apparatus in accordance with claim 1 wherein said actuator means is pneumatically operated.

* * * * *